US005080713A

United States Patent [19]

Ishibashi et al.

[11] Patent Number: 5,080,713

[45] Date of Patent: Jan. 14, 1992

[54] HARD ALLOY PARTICLE DISPERSION TYPE WEAR RESISTING SINTERED FERRO ALLOY AND METHOD OF FORMING THE SAME

[75] Inventors: Akiyoshi Ishibashi; Kazutoshi Takemura, both of Saitama; Makoto Abe, Kanagawa; Akira Fujiki, Kanagawa; Kimitsugu Kiso, Kanagawa; Takaaki Ito, Tokyo, all of Japan

[73] Assignees: Kabushiki Kaisha Riken, Tokyo; Nissan Motor Company, Limited, Yokohama, both of Japan

[21] Appl. No.: 338,167

[22] Filed: Apr. 14, 1989

[30] Foreign Application Priority Data

Apr. 18, 1988 [JP] Japan ..... 63-93513

[51] Int. Cl.[5] ..... B22F 00/00

[52] U.S. Cl. ..... 75/246; 75/239; 75/240; 75/241; 75/242; 75/252; 75/255; 419/14; 419/15; 419/32; 419/38

[58] Field of Search ..... 75/246, 239, 240, 241, 75/242, 252, 255; 419/38, 32, 14, 15

[56] References Cited

U.S. PATENT DOCUMENTS

| | | | |
|---|---|---|---|
| 4,204,031 | 5/1980 | Takemura et al. | 428/539 |
| 4,505,988 | 3/1985 | Urano et al. | 428/569 |
| 4,552,590 | 11/1985 | Nakata et al. | 75/246 |

FOREIGN PATENT DOCUMENTS

| | | |
|---|---|---|
| 202035 | 11/1986 | European Pat. Off. . |
| 266935 | 5/1988 | European Pat. Off. . |
| 56-158846 | 12/1981 | Japan . |
| 61-64855 | 4/1986 | Japan . |
| 62-146246 | 6/1987 | Japan . |
| 2157711 | 10/1985 | United Kingdom . |

*Primary Examiner*—Brooks H. Hunt
*Assistant Examiner*—Ngoclan Mai
*Attorney, Agent, or Firm*—Foley & Lardner

[57] ABSTRACT

A material for valve seats comprising a wear resisting sintered ferro alloy formed by dispersing particles of a high speed steel in a matrix in which hard alloy particles are dispersed. Steps for forming include mixing particles of a matrix material, carbide material and a hard alloy, and blending the mixture with high speed steel particles, pressurizing and compacting the mixture after blending, then sintering them at 1000° to 1200° C. In the preferred method, at least one element of Fe, C, Ni, Co, Si or Mn is included as the matrix material, and at least one element of Fe, Cr, Mo or V as the carbide material and at least one element of Fe, Cr, Mo, Co, C or W as the hard alloy are prepared. Furthermore, the ferro alloy preferably includes the following amounts of the above mentioned elements, 0.5 to 2.0 wt % of C, 1 to 25 wt % of one or more of Cr, Mo, V, or W and 1 to 15 wt % of one or more of Co, Ni, Mn, or Si.

20 Claims, No Drawings

HARD ALLOY PARTICLE DISPERSION TYPE WEAR RESISTING SINTERED FERRO ALLOY AND METHOD OF FORMING THE SAME

BACKGROUND OF THE INVENTION

1. Technical Field

This invention is related to the improvement of a hard alloy particle dispersion type wear resisting sintered ferro alloy.

2. Background Art

In the various fields, demand for ferro alloy with higher wear resistance becomes stronger. For example, according to the current trend of automotive internal combustion engine toward higher speed and higher performance, higher wear resistance has been required for the ferro alloy as a material for forming valve seats to be installed on an induction port and exhaust port of the engine. In order to answer such demand, Japanese Patent First Publication No. 53-81410 and Japanese patent Second (allowed) publication No. 57-3741 proposes a ferro alloy containing hard alloy dispersed in a base matrix.

As is well known, hard alloy has relatively low sintering ability. Therefore, when using hard alloy as particles for dispersion, it tends to cause formation of gaps in the sintered body and provides relatively weak coupling with the material of the base matrix. As a result, spalling of the hard alloy particle which is dispersed in the base matrix can occur to cause degradation of wear resistance of the ferro alloy, which can be lowered substantially. Therefore, if such a ferro alloy is used for forming the valve seat of the automotive engine, it may raise a problem of durability.

To protect hard alloy from wearing, it has been attempted to improve sintering by raising the sintering temperature, strengthening the alloy, and preventing the hard alloy from spalling by infiltrating Cu into gaps in the sintered alloy.

However, there remain some problems. Raising the sintering temperature causes the elements of the hard alloy to diffuse and in some cases, causes loss of or degradation of its property as a hard alloy. For this reason, it is necessary to restrict and control the range of the sintering temperature. This causes extra steps to be taken, thereby lowering productivity and raising the cost of production. Additionally, when using Cu for infiltration Cu and ferro alloy are layered while heating. These steps are time consuming and again cause for lower productivity and high production costs.

A sintered substance of high speed steel particles is used for valve seat material in Europe. Though as a material for valve seats it has substantial wear resistance, it has about five times the production cost of using particles of hard alloy material, and a sintered substance of high speed steel has not enough wear resistance against automotive engines having high revolution speeds, such as Japanese automotive vehicles.

In view of the drawbacks in the prior art, the present invention is intended to provide a method of forming a ferro alloy having higher wear resistance which is suitable to use in forming valve seats of automotive engines, for example.

SUMMARY OF THE INVENTION

Therefore, it is an object of this invention to provide a hard alloy particle dispersion type sintered ferro alloy which has higher wear resistance than that which can be produced through the conventional process.

Another object of the invention is to provide a method of efficiently producing the hard alloy dispersed type ferro alloy according to the invention.

This invention takes advantage of the characteristics of high speed steel such as JISG4403, which forms a liquid phase on its surface at a relatively low temperature of about 1070° C., to improve sintering ability of particles v/a surface tension.

Further more, in high speed steel particles there are fine-grained intermetallic compounds or carbides, therefore they work function as hard alloy particles and alloy elements of high speed steel particles are dispersed from them during sintering, thereby causing a strengthening of the matrix and improving the wear resistance of the sintered ferro alloy.

According to this present invention, high speed steel particles are mixed with hard alloy particles dispersed in material particles of a matrix of the wear resisting ferro alloy. Then the mixture is compacted and sintered. The sintering is promoted due to the forming of the liquid phase on the surface of the high speed steel particles. This enhances the degree of sealing between the hard alloy and the matrix. Concurrently, it results that the wear resistance of the sintered substance is enhanced by the fine grains of high speed steel particles themselves which are dispersed therein. Therefore, it has great advantages in utility as a material to form parts which are subjected to extreme striking or rubbing actions, such as valve seats for high speed rotary engines.

DESCRIPTION OF THE PREFERRED EMBODIMENT

The following is a discussion concerning the details of the preferred embodiment according to the present invention. The present invention includes a ferro sintered alloy comprising the mixture of Fe, matrix, hard alloy and high speed steel. High speed steel particles are mixed with hard alloy particles dispersed in material particles of a matrix of the wear resisting ferro alloy to fill gaps formed between the hard alloy and the matrix. Then the mixture is compacted and sintered. High speed steel particles have the characteristic of forming a liquid phase on their surface. This enhances the degree of sealing between the hard alloy and the matrix. Concurrently, it results that the wear resistance of the sintered substance is enhanced by the fine grains of high speed steel particles themselves which are dispersed therein. Therefore, it has great advantages in utility as a material to form parts which are subjected to extreme striking or rubbing actions, such as valve seats for high speed rotary engines.

In order to carry out the invention, any high speed steel particles having chemical compositions such as JISG4403 can be used. Using more than one Mo type high speed steels which form a liquid phase on a surface thereof at relatively low temperatures, however, is more preferable.

The amount of high speed steel particles added is determined in a range of 2 to 20 wt%. If the amount of the high speed steel added is less than 2 wt%, no improvement for wear resistance is observed. On the other hand, when more than 20 wt% of high speed steel is added, there cannot be observed further enhancing of wear resistance corresponding to the amount of addition which would justify the rising production cost when more than 20 wt% is added.

Particle size is less than 100 mesh, preferably. If the size of the particles is larger, mixture of particles is easier to deflect and compacting becomes difficult.

Chemical compositions of the sintered ferro alloy are as follows;

C combines with Cr, Mo, V, W which are carbide elements. This results in the formation of a carbide which improves the wear resistance. The amount of C is determined inevitably in relation to the class and amount of carbides elements, hard alloy or high speed steel. In the case of this invention, it is between the range of 0.5 and 2 wt%. It is preferable that the amount of C is not less than 0.5 wt% because the yield of carbide would be insufficient to prevent formation of soft ferrites causing low wear resistance. On the other hand, it is also preferable that the amount of C is not more than 2 wt% because the material becomes so hard and fragile.

Cr, Mo, V, W, which are carbide elements, combine with C and improve the wear resistance by forming a carbide. This effect is evidenced by any of the above mentioned elements. Any one element or several of them mixed together may be used. The total amount of these elements present is between 1 and 25 wt% including elements present in the high speed steel. It is preferable that the total amount is not less than 1 wt% because the yield of a carbide would be insufficient to prevent formation of soft ferrites causing low wear resistance. On the other hand, it is also preferable that the total amount is not more than 25 wt% because the material becomes so hard and fragile, and production costs also become high.

As for other components, one of Co, Ni, Si, Mn or a mixture of them is included in the range of 1 to 15 wt% (including elements from the high speed steel) in order to improve the strength of the matrix or stabilize the mixture. It is preferable that the total amount of these other components is not less than 1 wt% because wear resistance would be insufficient and it is also preferable that the total amount of them is not more than 15 wt% because there is no improvement for wear resisting effects corresponding to the amount and raised production costs.

Still further, a portion of the above mentioned elements is added in the form of one or more hard alloys having a hardness higher than HMV 500. Such alloys as Fe-Mo, Fe-Cr-Co-Mo-C, Fe-W-Co-Cr-C, are added in order to raise the wear resistance of the sintered ferro alloy. It is preferable that the amount of hard alloy is between 2 wt% and 15 wt%. It is preferable that the amount of it is not less than 2 wt% because the wear resisting effect would be insufficient, and it is also preferable that the amount of it is not more than 15 wt% because the material becomes hard and fragile, and production costs become high.

Production steps such as compacting and sintering of the mixture, are not modified specifically compared with the prior art. About 0.5 wt% of zinc stearate is added to the mixed particles as a lubricant while compacting, conventionally. Therefore, when sintering, pre-heating is carried out so as to dewax at about 650° C. Temperature of sintering is preferably about 1000° to 1200° C. After sintering, portions of high speed steel particles remain high alloy steels.

EXAMPLE

As a base material, particles were blended, each component having an amount as follows;

43.1 wt% of pure Fe having 150 to 200 mesh peak size of particle, 43.1 wt% of Fe-2 wt% Ni-0.5 wt% Mo-0.2 wt% Mn particles having same size as the pure Fe, 1 wt% of Ni particles having a size under 325 mesh, 1.3 wt% of graphite having same size as Ni, 2 wt% of Fe-55 wt% Cr-20 wt% Mo-10 wt% Co-1.2 wt% C as a hard alloy having 150 to 200 mesh peak size of particle, and 4 wt% of Fe-63 wt% Mo particles, 5 wt% of Fe-12.5 wt% Cr particles, 0.5 wt% of zinc stearate as a lubricant.

Then a high speed steel classified as JISSKH 53 or 59 having a size of less than 100 mesh was added in a rate as shown in the notes below Table 1.

The mixture of the base material and the high speed steel particles was compacted by pressing under a pressure of 7t/cm$^2$, pre-heated 1 hour at 650° C. for dewaxing and heated again 1 hour at 1130° C. for sintering. By this procedure test piece materials were obtained. Table 1 shows the chemical composition of the test materials.

The materials were cut to the desired size for testing and an aptitude test for valve seat material was carried out by a simple abrasion test machine which imitates a real engine. Tests were carried out assuming usage under conditions of an inlet valve seat as shown in Table 2.

TABLE 1

| | Weight % | | | | | | | |
|---|---|---|---|---|---|---|---|---|
| No. | C | Cr | Ni | Mo | Co | W | V | Total alloy |
| 1 | 1.37 | 1.89 | 1.75 | 3.38 | 0.36 | 0.15 | 0.08 | 7.71 |
| 2 | 1.38 | 1.89 | 1.75 | 3.47 | 0.52 | 0.06 | 0.04 | 7.83 |
| 3 | 1.38 | 1.89 | 1.75 | 3.29 | 0.19 | 0.24 | 0.12 | 7.59 |
| 4 | 1.33 | 1.91 | 1.64 | 3.25 | 0.18 | 0.48 | 0.24 | 7.70 |
| 5 | 1.32 | 2.00 | 1.57 | 3.33 | 0.18 | 0.72 | 0.36 | 8.16 |
| 6 | 1.32 | 2.09 | 1.50 | 3.40 | 0.17 | 0.96 | 0.48 | 8.62 |
| 7 | 1.31 | 2.18 | 1.42 | 3.48 | 0.16 | 1.20 | 0.60 | 9.08 |
| 10 | 1.25 | 4.00 | — | 5.00 | — | 6.00 | 3.00 | 18.00 |
| 11 | 1.36 | 3.36 | 1.74 | 4.61 | 0.50 | — | — | 10.32 |
| 12 | 1.33 | 1.73 | 1.78 | 3.10 | 0.20 | — | — | 6.90 |

Notes;
(1) Total alloy: Cr + Mo + W + V + Ni + Co
(2) Blending rate of a high speed steel particle
No. 1 SKH 59: 4%
No. 2 SKH 59: 2%, SKH 53: 2%
No. 3 SKH 53: 4%
No. 4 SKH 53: 8%
No. 5 SKH 53: 12%
No. 6 SKH 53: 16%
No. 7 SKH 53: 20%
No. 10 SKH 53: 100%

TABLE 2

| | |
|---|---|
| Material of valve seat | SUH-3 |
| Surface temperature of valve head | 300° C. |
| Temperature of valve seat | 150° C. |
| Speed of cam rotation | 2500 rpm |
| Period of test | 5Hr |

TABLE 3

| | Amount of wearing (μm/5H) | | | |
|---|---|---|---|---|
| No. | Valve seat | Valve | Total | Remarks |
| 1 | 48 | 45 | 93 | |
| 2 | 53 | 19 | 72 | |

TABLE 3-continued

| No. | Amount of wearing (μm/5H) Valve seat | Valve | Total | Remarks |
|---|---|---|---|---|
| 3 | 50 | 38 | 88 | |
| 4 | 37 | 34 | 71 | |
| 5 | 36 | 42 | 78 | |
| 6 | 57 | 28 | 85 | |
| 7 | 64 | 25 | 89 | |
| 10 | 83 | 16 | 99 | SKH 53 |
| 11 | 63 | 38 | 106 | by Prior art |
| −2 | 90 | 57 | 147 | base material |

Note: Nos. 1 to 7 are materials formed by this invention and are mixed with high speed steel particles at the rate shown in Table 1 with a base material No. 12.

The results of the test are shown in Table 3. Comparing each material's total wearing of valve seat and valve, it is apparent that materials which relate to this invention exceed in wear resistance in spite of a total amount of alloy (wt%) which is less than No.11 formed by the prior art, and highly exceed in wear resistance compared with No.12 which is base material.

Although the invention has been shown and described with respect to detailed embodiments thereof, it should be understood by those skilled in the art that various changes in form and detail thereof may be made without departing from the spirit and the scope of the claimed invention.

What is claimed is:

1. A ferro alloy comprised of a base material forming a matrix, a hard alloy dispersed in said matrix in a form of a particle, wherein said hard alloy is present in a predetermined amount in relation to said base material, and a high speed steel also dispsersed in said matrix so as to fill gaps formed between said hard alloy and said matrix.

2. The ferro alloy as in claim 1, wherein said ferro alloy comprises:

a mixture of particles having a first component as a matrix material and a second component as a carbide material and a third component as a hard alloy, the first component having at least one element selected from the group consisting of Fe, C, Ni, Co, Si and Mn in the form of a particle, the second component having at least one element selected from the group consisting of Fe, Cr, Mo and V in the form of a particle and the third component having at least one element selected from the group consisting of Fe, Cr, Mo, Co, C and W in the form of a particle, a high speed steel particle blended with said mixture of particles before being pressurized and compacted to enhance the sealing between said hard alloy particle and said matrix and, a balance of Fe,

3. The ferro alloy as in claim 2, wherein said elements are present in amounts within the following ranges:

0.5 to 2.0 wt% of C, 1 to 25% for the total amount of the elements selected from the group consisting of Cr, Mo, V and W, and 1 to 15 wt% for the total amount of the elements selected from the group consisting of Co, Ni, Mn and Si.

4. The ferro alloy as in claim 2, wherein said mixture of particles is sintered at 1000° to 1200° C.

5. A valve seat formed by a wear resisting sintered ferro alloy, wherein said ferro alloy is comprised of a base material forming a matrix, a hard alloy dispsersed in said matrix in a form of a particle, wherein said hard alloy is present in a predetermined amount in relation to said base material, and a high speed steel also dispsersed in said matrix so as to fill gaps formed between said hard alloy and said matrix.

6. The valve seat as in claim 5, wherein said ferro alloy comprises:

a mixture of particles having a first component as a matrix material and a second component as a carbide material and a third component as a hard alloy, the first component having at least one element selected from the group consisting of Fe, C, Ni, Co, Si and Mn in the form of a particle, the second component having at least one element selected from the group consisting of Fe, Cr, Mo and V in the form of a particle and the third component having at least one element selected from the group consisting of Fe, Cr, Mo, Co, C and W in the form of a particle, a high speed steel particle blended with said mixture of particles before being pressurized and compacted to enhance the binding between said hard alloy particle and said matrix and a balance of Fe.

7. The valve seat as in claim 5, wherein said elements are present in amounts within the following ranges:

0.5 to 2.0 wt% of C, 1 to 25 wt% for the total amount of the elements selected from the group consisting of Cr, Mo, V and W, and 1 to 15 wt% for the total amount of the elements selected from the group consisting of Co, Ni, Mn and Si.

8. The valve seat as in claim 5, wherein said mixture of particles is sintered at a temperature of 1000° to 1200° C.

9. A method of forming a ferro alloy comprising the steps of:

forming a matrix of a base material, dispersing a hard alloy in said matrix in a form of particles, wherein said hard alloy is present in a predetermined amount in relation to said base material, and dispersing a high speed steel also in said matrix so as to fill gaps formed between said hard alloy and said matrix.

10. The method of forming the ferro alloy as in claim 9, wherein said method comprises the steps of:

mixing of particles having a first component as a matrix material and a second component as a carbide material and a third component as a hard alloy, the first component having at least one element selected from the group consisting of Fe, C, Ni, Co, Si and Mn in the form of a particle, the second component having at least one element selected from the group consisting of Fe, Cr, Mo and V in the form of a particle and the third component having at least one element selected from the group consisting of Fe, Cr, Mo, Co, C and W in the form of a particle, blending high speed steel particles with said mixture of particles before pressurizing and compacting to enhance the binding between said hard alloy particle and said matrix, wherein the balance of the alloy comprises Fe.

11. The method of forming the ferro alloy as in claim 10, wherein said elements are present in amounts within the following ranges:

0.5 to 2.0 wt% of C, 1 to 25 wt% for the total amount of the elements selected from the group consisting of Cr, Mo and W, and 1 to 15 wt% for the total amount of the elements selected from the group consisting of Co, Ni, Mn and Si.

12. The method of forming the ferro alloy as in claim 10, wherein said mixture of particles is sintered at a temperature of 1000° to 1200° C.

13. A method of forming a valve seat comprised of a wear resisting sintered ferro alloy, comprising the steps of:

forming a matrix of a base material, dispersing a hard alloy in said matrix in a form of particles, wherein said hard alloy is present in a predetermined amount in relation to said base material, and dispersing a high speed steel also in said matrix so as to fill gaps formed between said hard alloy and said matrix.

14. The method of forming a valve seat as in claim 13, wherein said method comprises the steps of:

mixing of particles having a first component as a matrix material and a second component as a carbide material and a third component as a hard alloy, the first component having at least one element selected from the group consisting of Fe, C, Ni, Co, Si and Mn in the form of a particle, the second component having at least one element selected from the group consisting of Fe, Cr, Mo and V in the form of a particle and the third component having at least one element selected from the group consisting of Fe, Cr, Mo, Co, C and W in the form of a particle, blending high speed steel particles with said mixture of particles before pressurizing and compacting to enhance the binding between said hard alloy particle and said matrix, wherein the balance of the alloy comprises Fe.

15. The method of forming the valve seat as in claim 14, wherein said elements are present in amounts within the following ranges:

0.5 to 2.0 wt% of C, 1 to 25 wt% for the total amount of the elements selected from the group consisting of Cr, Mo and W, and 1 to 15 wt% for the total amount of the elements selected from the group consisting of Co, Ni, Mn and Si.

16. The method of forming the valve seat as in claim 14, wherein said mixture of particles is sintered at a temperature of 1000° to 1200° C.

17. The ferro alloy as in claim 1, wherein between 2 and 15 wt% of said hard alloy is present.

18. The ferro alloy as in claim 5, wherein between 2 and 15 wt% of said hard alloy is present.

19. The method of forming ferro alloy as in claim 9, wherein between 2 and 15 wt% of said hard alloy is present.

20. The method of forming a valve seat as in claim 13, wherein between 2 and 15% of said hard alloy is present

* * * * *